US005732837A

United States Patent [19]

Jones

[11] Patent Number: 5,732,837

[45] Date of Patent: *Mar. 31, 1998

[54] VENTED VIAL CLOSURE MEMBER FOR FREEZE-DRYING WHICH MINIMIZES CONTAMINATION OF FREEZE-DRIED PRODUCTS

[75] Inventor: C. Bradford Jones, Newark, Del.

[73] Assignee: W. L. Gore & Associates, Inc., Newark, Del.

[ * ] Notice: The term of this patent shall not extend beyond the expiration date of Pat. No. 5,596,814.

[21] Appl. No.: 609,227

[22] Filed: Mar. 1, 1996

Related U.S. Application Data

[63] Continuation-in-part of Ser. No. 292,992, Aug. 19, 1994, abandoned.

[51] Int. Cl.[6] ..... B65D 51/16

[52] U.S. Cl. ..... 215/311; 215/308

[58] Field of Search ..... 215/311, 307, 215/308

[56] References Cited

U.S. PATENT DOCUMENTS

| | | | |
|---|---|---|---|
| 380,782 | 4/1888 | Barrett et al. . | |
| 583,972 | 6/1897 | Beavis | 215/311 X |
| 637,459 | 11/1899 | Handley . | |
| 2,908,274 | 10/1959 | Bujan . | |
| 2,997,397 | 8/1961 | Doulgheridis | 215/311 X |
| 3,293,773 | 12/1966 | Frazer et al. . | |
| 3,454,178 | 7/1969 | Bender et al. . | |
| 3,826,396 | 7/1974 | Frassica | 215/307 X |
| 4,261,474 | 4/1981 | Cohen | 215/308 X |
| 5,234,739 | 8/1993 | Tanaru et al. . | |
| 5,309,649 | 5/1994 | Bergmann et al. . | |
| 5,596,814 | 1/1997 | Zingle et al. | 215/308 X |

FOREIGN PATENT DOCUMENTS

| | | |
|---|---|---|
| 0261341 | 3/1988 | European Pat. Off. . |
| 0343596 | 11/1989 | European Pat. Off. . |
| 0500249 | 8/1992 | European Pat. Off. . |
| 2900858 | 7/1980 | Germany . |
| WO 88/01605 | 3/1988 | WIPO . |

*Primary Examiner*—Jes F. Pascua
*Attorney, Agent, or Firm*—Gary A. Samuels

[57] ABSTRACT

A closure member for use in closing vials that are subjected to lyophilization conditions is described where the member is a resilient stopper that has a plug movable within a passageway in the stopper. The plug is movable between a first raised venting position and second downwardly engaging, sealing position whereby fluid from the vial or container is precluded from flowing through the fluid passageway in the cap. The passageway has a venting medium filter covering it which allows passage of water vapor, but not bacteria.

8 Claims, 3 Drawing Sheets

VENTED VIAL CLOSURE MEMBER FOR FREEZE-DRYING WHICH MINIMIZES CONTAMINATION OF FREEZE-DRIED PRODUCTS

CROSS REFERENCE TO RELATED APPLICATION

This application is a continuation-in-part of application Ser. No. 08/292,992, filed Aug. 19, 1994, now abandoned.

FIELD OF THE INVENTION

This invention relates to a vial closure member for use in venting a vial that is used in freeze-drying processes. The closure member is designed to protect the contents of the vial from contamination while allowing a path for water vapor to escape from the vial during the freeze-drying process.

BACKGROUND OF THE INVENTION

Freeze-drying is used for the preservation of a wide variety of foods, pharmaceuticals, and biological products. Extreme care must be taken in handling and processing many of these products to minimize opportunities for contamination. For example, freeze-drying equipment is often steam-sterilized between batches, and in many cases the entire operating area in which the equipment is located may be outfitted as a sterile clean room to minimize the exposure of products to contaminants as they are being transported to and from the freeze-dryer. In many cases, products must be re-packaged after freeze-drying, thus presenting yet another handling step that provides an opportunity to introduce contaminants into the freeze dried product.

Many freeze-drying processes involve placing open containers of material in the freeze-dryer. Containers are kept open until the freeze-drying process is completed to allow a path for water vapor to be removed from the product. This practice, however, presents an opportunity for contamination; hence the concern for cleanliness and sterility of the freeze-drying equipment and the area surrounding it.

Cross-contamination between different batches of product being dried at the same time is also a problem. Freeze-drying equipment is expensive, and freeze-drying cycles are generally very long, consuming many hours or even several days for the processing of a single batch of material. As a result, it is very common for freeze-dryer operators to maximize the use of their capital investment in equipment by attempting to fully load the freeze-drying chamber every time it is cycled. This in turn results in the common practice of freeze-drying different materials in the same chamber at the same time. Since all the materials are in open containers, cross-contamination of product can, and commonly does, occur.

For example, in U.S. Pat. No. 3,454,178 to Bender, et al., a vial contains a slotted vial cap that, when in the "up" position, allows a path for water vapor to escape the vial. Vials are introduced into the process with their caps in the "up" position, and remain that way until the drying cycle is complete. At the end of the cycle, freeze-drier shelves squeeze down on the vials and press the caps into the "down" position, thus sealing the vials before the drier door is opened. This approach assures that contents of the vials are not contaminated after the process is complete. It also assures that water vapor cannot enter the vials and rehydrate the product once the drier doors are open; indeed, the vials are often repressurized at the end of the process with a dry inert gas, such as nitrogen, prior to pushing the vial caps into the "down" position, to maximize the shelf life of the freeze-dried product. But the problem of contamination of the vial contents when the vials are being loaded into the drier or during the freeze-dry process itself is not addressed by this patent.

In European Patent No. 343,596, a container that has been designed to protect freeze-dried products from contamination during the freeze-drying process is described. The container has at least one side that includes a hydrophobic, porous, germ-tight, water vapor-permeable membrane. Water vapor can escape the closed container through this porous membrane, while the membrane represents a barrier to contamination. Another technique used, such as that taught in U.S. Pat. No. 5,309,649 to Bergmann., involves freeze-drying material in a container that has a porous hydrophobic wall. Neither of these patents, however, addresses the concern about re-hydrating the contents of the container once the doors of the drier are opened. It is not obvious how products freeze-dried in such a container could be kept dry and finally packaged in a vapor-tight container without first exposing the dried product to humidity. Thus, a need exists for a container for freeze-dried products that maintains a well-defined level of protection throughout the entire drying process, as well as providing means for forming a vapor-tight seal on the container before the dryer doors are open.

SUMMARY OF THE INVENTION

This invention relates to a vial closure member that provides a well-defined degree of protection of the contents of a lyophilization vial throughout the entire life cycle of the vial's contents, from the time the product is introduced into the vial prior to freeze-drying, to the time the vial is ultimately opened by the end-user.

The vial closure member of the present invention incorporates a venting port that is protected by a water-vapor permeable porous venting medium. The porous venting medium provides a barrier to bacteria and other particulate contamination, while permitting the passage of gasses such as air and water vapor. The closure member is designed to fit securely in or about the mouth of the vial so that once in place, it forms a bacterial-resistant seal that provides a well-defined degree of protection for the contents of the vial.

One feature of the closure member is that, while it is sealed in place in the throat of a vial, its venting port can be opened to permit vapor flow through the venting medium or closed to block vapor flow by means of a plug located in the venting port which is constructed and arranged so that in a raised position an air path is opened through the port and in a lowered position the air path is sealed. A feature of the invention is that closure of the venting port can be accomplished by simply pressing down on the top of the plug.

These and other purposes of the present invention will become evident from a review of the following description when considered in conjunction with the accompanying drawings.

DETAILED DESCRIPTION OF THE INVENTION

The present invention relates to closure members that are used with containers, e.g., bottles, vials, etc., that are subjected to lyophilization processes, wherein the contents of the container are lyophilized. They will be referred to herein as "vials." The closure member of the present invention includes:

1. A body in the form of a resilient stopper, shaped to form a vapor-tight seal with the mouth of a vial.

2. A venting port that comprises a passage through the stopper and which provides a pathway between the interior of the bottle and the exterior of the bottle 3. A water vapor permeable, venting medium or filter that is located in the path of vapor travel through the venting port and which is a barrier to penetration by bacteria, and preferably is also a barrier to penetration by liquid water.

4. Means for permitting the venting port to be opened or sealed comprising a plug located in the venting port which is constructed and arranged so that in a raised position an airpath is opened through the port and in a lowered/closed position the airpath is sealed.

Figure 1:
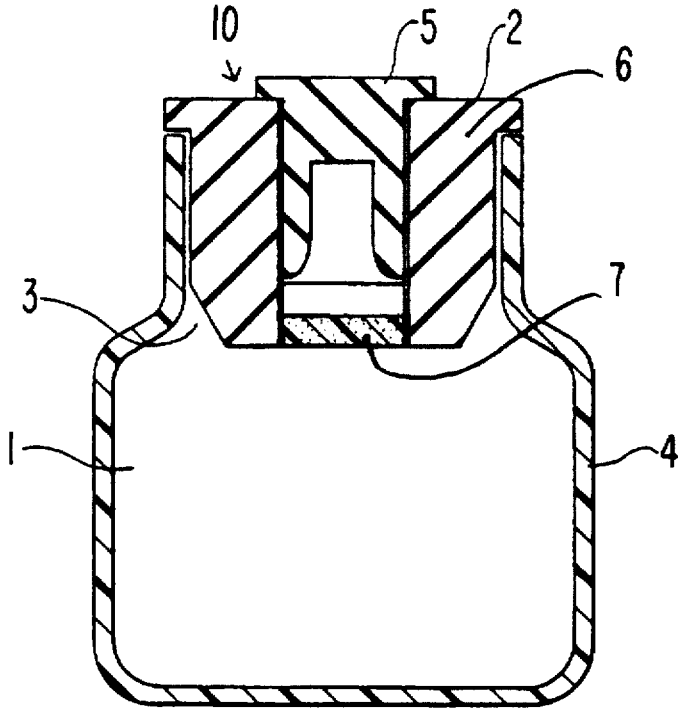
FIG. 1 shows a cross-section of a vial with a closure member of the present invention.

The present invention will now be described with reference to FIGS. 1–9. FIG. 1 shows vial closure member 10 in the mouth 3 of vial 1. Closure member 10 comprises resilient stopper 6 and a movable plug 5. In FIG. 1, the mouth 3 has a smaller diameter than the vial body. However, the mouth 3 and the vial body can also have the same diameter, or the mouth could be larger than the bottle. The venting medium is shown as 7. The closure member 10 of FIG. 1 is described in greater detail in the discussion below relating to FIGS. 2–9.

Figure 2:
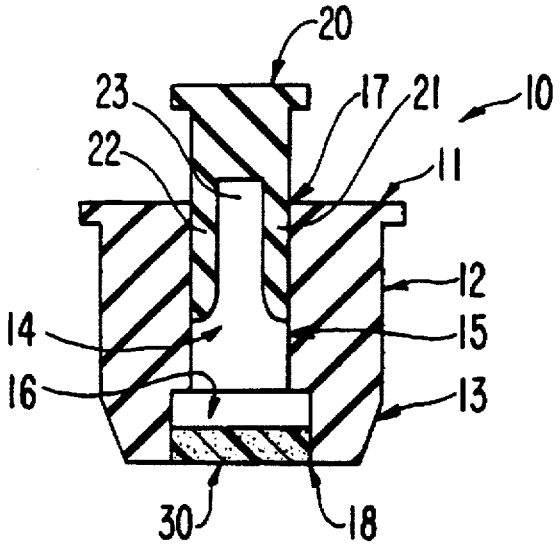
FIG. 2 shows the closure member of FIG. 1 in open position.

In FIG. 2, closure member 10 has a stopper body 11 of resilient material with a cylindrical section 12, a tapered portion 13, and an inner channel or venting port 14. The channel 14 is shown to have a stepped configuration, although other designs are possible, and includes upper end 15 and lower end 16. Ends 15 and 16 have respective openings 17 and 18 to respectively receive plug member 20 and venting medium 30.

Figure 3:
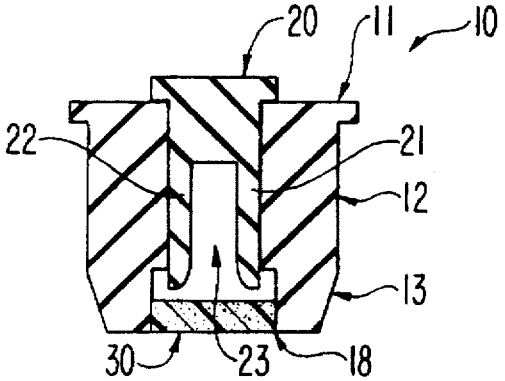
FIG. 3 shows the closure member of FIG. 1 in closed position.

The plug member 20 is shown in an open venting position in FIG. 2 and a closed, non-venting position in FIG. 3. In FIGS. 2 and 3, plug member 20 has two downwardly extending legs 21 and 22 that are spaced apart from one another to provide a passageway or channel 23 for fluids to be vented from the interior of vial 1 (FIG. 1) through venting medium filter 30. The outer diameter formed by said downwardly extending legs is sufficiently large so that the plug member 20 may be resiliently maintained in an upper, open venting position with end 15. Although plug member 20 is shown as having two legs, it is possible to have three or more downwardly extending legs.

Porous venting medium 30 extends across opening 18. By the term porous venting medium is meant any material that is water vapor permeable, and which provides effective resistance to bacteria penetration. Examples of porous venting media include papers, non-woven polymer films such as polyolefin, e.g., spun-bonded Tyvek®, and porous polymer membranes such as expanded porous PTFE. It is preferred that the venting medium be hydrophobic. By the term hydrophobic is meant that the medium is resistant to penetration by water. Preferably, the materials' resistance to water vapor flow versus effective pore size should also be considered. Pore sizes in the 0.2 to 3.0 micrometer range will yield performance in bacterial challenge tests that are generally associated with "sterile barrier" media. The smaller the pore size, the more reliable the barrier performance. For the aforesaid, porous, stretched PTFE, which has a microstructure of nodes interconnected with fibrils, nominal pore sizes of 0.1 micrometer, or 0.2 or up to 3 or more micrometers are useful. On the other hand, smaller reference pore sizes in a given material will also yield higher resistance to vapor flow, which can affect productivity in lyophilization. Stretched, porous PTFE is a preferred venting medium based on its superior combination of hydrophobicity and water vapor flow for a given nominal pore size.

While the venting media is shown to be located within the opening 18, it is also contemplated to affix the peripheral edge of the venting medium to the bottom most edge of tapered portion 13.

The operation of the device of FIGS. 1–3 is as follows. Closure member 10 is inserted into the mouth of the vial and provides a barrier against contamination of the vial contents from bacteria or other particulate contamination from the outside. It also prevents the loss of particulates and their contamination from inside the vial. As shown in FIG. 2, when the plug 20 is in the "up" position, the channel slot or passageway 23 in plug 20 presents a path for vapors to enter or leave the vial. When plug 20 is pressed into the "down" position, FIG. 3, it seals the vent port, thus prohibiting further passage of water vapor or other gases into or out of the vial.

Figure 4:
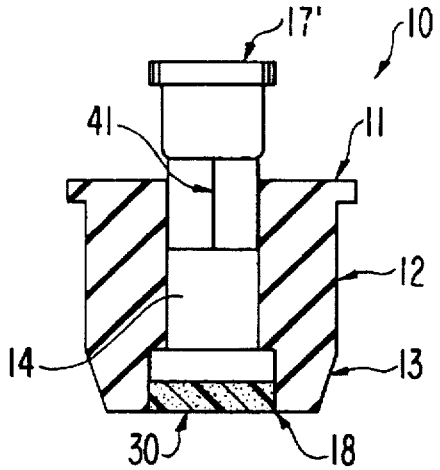
FIGS. 4–6 show a closure member of the present invention using a finned plug.
Figure 5:
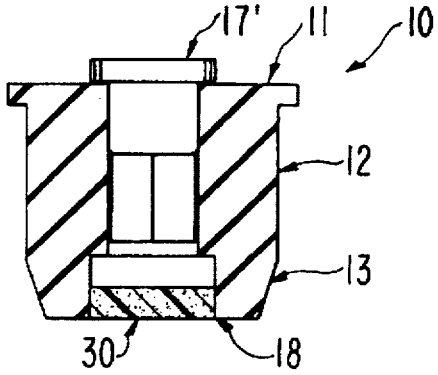
Figure 6:
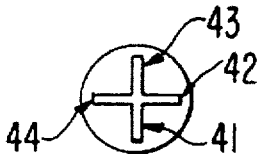

FIGS. 4–9 depict closure members that differ from that of FIGS. 2 and 3 in design. In FIGS. 4–6, plug member 17' is supported on rigid vanes 41, 42, 43 and 44 that allow plug 17' to ride up and down in channel or venting port 14. FIG. 4 shows plug member 17' in the "up" position for venting whereby vapor can travel throughout channel 14 around the vanes 41–44.

FIG. 5 shows plug member 17' in the down non-venting position. FIG. 6 shows a bottom view of plug member 17' with vanes 41–44.

Figure 7:
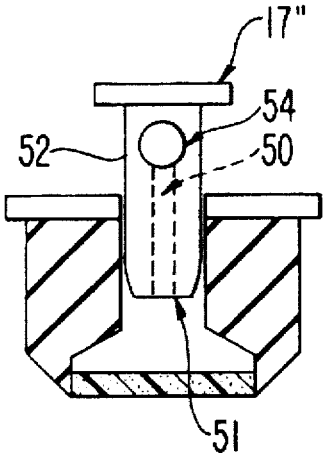
FIG. 7 shows a closure member of the present invention using a plug member having an interiorly located venting port.

In FIG. 7, the plug member 17" has a passage 50 that opens at the bottom 51, runs up part of the length 52 of plug member 17", and exits the side of the plug member 17" via side exit or port 54. Again, when the plug is in the "up" position (FIG. 7), vapor can travel through passage 50; when the plug member 17" is pressed down, the side exit or port 54 of passage 54 is blocked off and the port 54 is closed.

Figure 8:
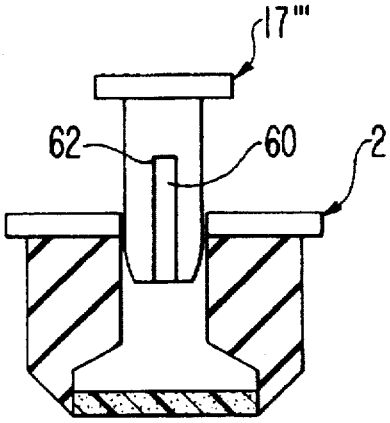
FIGS. 8 and 9 show a closure member of the present invention using a plug member having a surface channel venting port.
Figure 9:
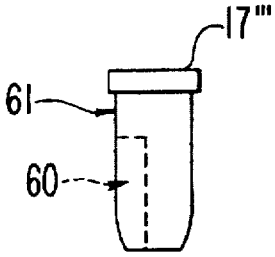

In FIGS. 8–9, the plug member 17'" has a slot 60 in its side 61 that permits vapor flow when the top 62 of the slot 60 is exposed above the top of assembly cap 2.

It can be seen that there are a number of other specific configurations that could be conceived that would remain within the scope or spirit of this invention. Likewise, there are a wide variety of materials that may be used. A key consideration for the stopper and plug material is the materials' ability to resist moisture penetration or retention, and to maintain an excellent vaporproof seal over a wide range of temperatures. Stoppers of butyl rubber have provided excellent performance.

As indicated in the figures, there are a wide variety of configurations of vent ports, venting media, vent port stoppers and plugs that may be used that would remain within the scope of this invention.

An exemplary process for using the vented vial closure of the subject invention includes, but is not limited to:

(a) filling the vial with product under sterile conditions;

(b) inserting the closure member of the present invention into the mouth of the bottle with the vent plug in the "open" position;

(c) freeze-drying the product in the vial, allowing the water vapor to escape through the venting medium and the venting port;

(d) optionally re-pressurizing the chamber and the vial with a dry, inert gas such as nitrogen; and (e) sealing the venting port by pressing down on the plug.

EXAMPLE 1

Venting Medium Tests

To demonstrate that stretched, porous PTFE membranes in the 0.2 micron to 3.0 micrometers reference pore size range could provide an effective venting medium and a barrier to cross-contamination between vials, the following three experiments were run:

Liquid Challenge Test

In some cases, the membrane might be challenged by contaminated liquid. For example, if a liquid pharmaceutical vial tips over before it is frozen. To demonstrate that the vented vial could retain contaminants in the liquid under such conditions, a liquid challenge test was devised.

In the test, sample membranes obtained from W. L. Gore & Associates, Inc. were challenged with a suspension of ϕX174 bacteriophage, one of the smallest known viruses, in tryptone broth. Challenge concentration was maintained at at least 100 million PFU/ml. Sterile membrane was contacted with the challenge suspension for 5 minutes at atmospheric pressure; the pressure on the challenge side was then slowly increased to a pressure below the water entry pressure of the membrane sample (as indicated in Table 1), and then held constant for an additional 5 minutes. The reverse side of the membranes were then rinsed and assayed for ϕX174. No virus breakthrough was detected.

TABLE 1

| Reference Pore Size | Test Pressure | Challenge Titer (PFU/ml.) | Assay Titer (PFU/ml.) |
|---|---|---|---|
| 0.2 | 20 psig | $1.8 \times 10^8$ | 0 |
| 0.45 | 20 psig | $1.4 \times 10^8$ | 0 |
| 1.0 | 15 psig | $1.4 \times 10^8$ | 0 |
| 3.0 | 2 psig | $1.4 \times 10^8$ | 0 |

Particle Challenge Test

Another possible scenario is that, during drying, very small particles of freeze-dried material could be entrained by vapor evolving below them in the vial and be drawn out of the vial in that manner (this is quite common in freeze-dry processes). To demonstrate that the venting medium could present a barrier to contaminants being carried under this condition, a dry particle filtration challenge test was devised.

Salt particles were generated by air drying a finely atomized mist of salt water; the membranes were challenged with an air flow carrying these particles and the particles that penetrated were counted in the downstream air flow by redundant laser particle counters. Air velocity at the membrane surface was >2 meters/minute. Results of this filtration efficiency test are shown in Table 2.

TABLE 2

Filtration Efficiency of Sample Membranes

| Particle Size (μ) | 0.2 | 0.45 | 1.0 | 3.0 |
|---|---|---|---|---|
| 0.10–0.12 | 100.000000% | 99.999977% | 99.999954% | 99.999892% |
| 0.12–0.15 | 100.000000% | 99.999985% | 99.999985% | 99.999926% |
| 0.15–0.20 | 100.000000% | 99.999985% | 99.999985% | 99.999936% |
| 0.20–0.25 | 100.000000% | 100.000000% | 100.000000% | 99.999936% |
| 0.25–0.35 | 100.000000% | 100.000000% | 100.000000% | 99.999931% |
| 0.35–0.45 | 100.000000% | 100.000000% | 100.000000% | 100.000000% |
| 0.45–0.60 | 100.000000% | 100.000000% | 100.000000% | 100.000000% |
| 0.60–0.75 | 100.000000% | 100.000000% | 100.000000% | 100.000000% |
| 0.75–1.00 | 100.000000% | 100.000000% | 100.000000% | 100.000000% |

This is a demonstration of the fact that the millions of very fine fibrils in expanded porous PTFE is a unique structure providing very high air filtration efficiencies through the mechanisms of impaction, interception, and diffusion within the membrane.

Aerosol Challenge Test

While it is undesirable in the freeze dry process, it can be imagined that under certain conditions liquid might form on the venting medium or in the vial during the freeze dry process, and small droplets might be entrained by the evolving vapors. Contamination could be carried in these droplets out through the vent port. To demonstrate that the venting medium could provide a barrier to contaminants that are carried in a fine spray of liquid, the membranes were subjected to a viral filtration efficiency test, a test that is commonly used in testing packaging for sterile medical devices such as disposable surgical instruments or implants.

In this test, ϕX174 bacteriophage stock suspension was pumped through a "Chicago" nebulizer at a controlled flow rate and fixed air pressure to form aerosol droplets with a mean particle size of 2.9 microns. The air flow carrying the droplets was driven through the membrane samples and then into a six stage "viable particle" Andersen sampler, which impinges the aerosol droplets onto one of six agar plates based on size. Samples of 0.2, 0.45, 1.0, and 3.0 micron reference pore size membrane were challenged in this test. After the challenges, the agar plates were incubated at 37° C. for 4–18 hours. The plaques formed by each virus-laden particle were then counted and converted to probable hit values using the published conversion chart of Andersen.

No colonies were detected downstream of any of the membrane samples.

EXAMPLE 2

To demonstrate that freeze-drying could be successfully accomplished with the closure member of the invention, prototypes of the design shown in FIG. 1 were evaluated in a commercial bone tissue bank application. The objective of this application is to reduce moisture content of bone chips to 1–5% by weight.

Vial caps of the design indicated in FIG. 1 were fabricated using a 0.2 micron reference pore size expanded PTFE membrane as the venting media. The stopper bodies were made of butyl rubber, and they were sized to mate with the vials that were used in a standard lyophilization process.

The vials and caps were sterilized. Bone chips were placed in the vials, and the stopper bodies firmly sealed in the mouth of the vial with the vent port plugs in the "up" position. Thus, as the vials were introduced to the process, the only path available for water vapor to escape from the vials was through the venting medium and out the vent port. The vials were then placed in a drier; the door was closed, the temperature was reduced to −80° C., and a vacuum was drawn. The bone was dried in a 14 day cycle, during which time the vent port plugs were in the "up" position so that water vapor could escape. At the end of the cycle, automatic shelf assemblies squeezed down, sealing the plugs and thus sealing the vial under a dry vacuum condition. The drying chamber was then re-pressurized with nitrogen, and then the doors were opened and the sealed vials were removed. With this process, moisture content of the bone chips was reduced to the vicinity of 1–5% by weight and maintained at that low level until the vials were re-opened.

I claim:

1. A vial closure member for use in lyophilization of the vial's contents, which comprises:

(a) a body in the form of a resilient stopper, said body shaped to form a vapor-tight seal with the mouth of the vial;

(b) a venting port comprising a passage through the body which provides a pathway between the interior of the vial and the exterior;

(c) a water-vapor permeable, venting medium that is a barrier to penetration by bacteria, located in the path of vapor travel through the venting port passage;

(d) means for opening and closing off the venting port to and from the interior of the vial comprising a plug located in the venting port which is constructed and arranged so that in a raised position an air path is opened through the port and in a lowered/closed position the air path is sealed.

2. The vial closure member of claim 1 wherein the venting medium is also a barrier to penetration by liquid water.

3. The vial closure member of claim 2 wherein the venting medium is made of stretched, microporous polytetrafluoroethylene.

4. The vial closure member of claim 1 wherein the air path is formed by a hole extending through the plug.

5. The vial closure member of claim 1 wherein the air path is formed by a slot in the plug.

6. The vial closure member of claim 1 wherein the air path is formed by a plurality of spaced apart, downwardly extending legs on said plug.

7. The vial closure member of claim 1 wherein the air path is formed by a plurality of downwardly expanding vanes on said plug.

8. The vial of claims 1, 4, 5, 6, or 7 wherein the venting medium is made of stretched, microporous polytetrafluoroethylene.

* * * * *